US005244449A

United States Patent [19]

Totani

[11] Patent Number: 5,244,449

[45] Date of Patent: Sep. 14, 1993

[54] APPARATUS FOR FEEDING A CONTINUOUS PLASTIC FILM

[75] Inventor: Mikio Totani, Muko, Japan

[73] Assignee: Totani Giken Kogyo Co., Ltd., Kyoto, Japan

[21] Appl. No.: 889,147

[22] Filed: May 27, 1992

[30] Foreign Application Priority Data

May 30, 1991 [JP] Japan ..... 3-157718

[51] Int. Cl.[5] ..... B65H 19/00

[52] U.S. Cl. ..... 493/194; 156/157; 156/304.6; 156/504; 493/346

[58] Field of Search ..... 493/194, 210, 341, 346, 493/381; 156/152, 157, 159, 304.6, 379.8, 379.9, 504, 544

[56] References Cited

U.S. PATENT DOCUMENTS 5,045,134 9/1991 Schenker ..... 156/504
5,064,488 12/1991 Dickey ..... 156/504

FOREIGN PATENT DOCUMENTS 61-045860 3/1986 Japan .
1-139455 5/1989 Japan .
2204305A 11/1988 United Kingdom .

*Primary Examiner*—Bruce M. Kisliuk
*Assistant Examiner*—Jack Lavinder
*Attorney, Agent, or Firm*—Morgan & Finnegan

[57] ABSTRACT

According to the invention, an apparatus is provided for feeding a continuous plastic film from a source of supply to a plastic film processing machine such as a plastic bag making machine and the like, which includes first and second take up rolls for taking up and rewinding the plastic film. First guide means is disposed at a position in the path for directing the plastic film from the source of supply to the first take up roll via the first guide means. Second guide means is disposed downstream of the first guide means in the path for directing the plastic film from the second take up roll to the processing machine via the second guide means. The plastic films can be sandwiched between and heat cut widthwise by first heat cutting means and first receiving means, whereby the plastic film from the source of supply is connected to the plastic film to the processing machine, while the plastic film to the first take up roll is connected to the plastic film from the second take up roll. The plastic film can be sandwiched between and heat cut widthwise by the second heat cutting means and the second receiving means, whereby the plastic film from the source of supply is connected to the plastic film to the first take up roll, while the plastic film from the second take up roll is connected to the plastic film to the processing machine.

6 Claims, 1 Drawing Sheet

APPARATUS FOR FEEDING A CONTINUOUS PLASTIC FILM

BACKGROUND OF THE INVENTION

1. Field of the Invention

The invention relates to an apparatus for feeding a continuous plastic film from a source of supply to a plastic film processing machine such as a plastic bag making machine and the like.

2. Description of the Prior Art

A plastic bag making machine has been generally used for making household garbage bags from a continuous plastic film of material such as polyethylene. The plastic film is fed from a source of supply to a plastic bag making machine. The source of supply may comprises an inflation apparatus in which the molten plastic raw material is directed into a cylindrical die and blown up by air, whereby a tubular plastic film is continuously produced and fed. The tubular plastic film is then heat cut widthwise in the plastic bag making machine to make household garbage bags.

A problem is sometimes encountered in utilizing the inflation apparatus to the plastic bag making machine. As noted, the inflation apparatus should not be temporarily stopped during operation from the point of view of efficiency. Accordingly, even though the bag making machine is temporarily stopped for adjustment, the plastic film is constantly fed from the inflation apparatus not stopped. In this connection, it has been heretofore required to manually cut the plastic film between the inflation apparatus and the bag making machine, when stopping the bag making machine. The plastic film fed from the inflation apparatus is then manually directed to and taken up about a winder. When the bag making machine is restarted, the plastic film between the infration apparatus and the winder and the plastic film to the bag making machine are manually directed to a position to be put together and heat cut by an impulse heater so that the plastic film from the inflation apparatus is connected to the plastic film to the plastic bag making machine. The plastic film is then fed from the inflation apparatus to the plastic bag making machine. This operation involves labour and time consumption.

A packaging machine has been also used. A continuous plastic film is fed from a source of supply to the packaging machine to pack articles in the plastic film. In this case, when the packaging machine is temporarily stopped, while the source of supply is not stopped, it has been heretofore required to manually cut the plastic film between the source of supply and the packaging machine, and direct to and take up about a winder the plastic film fed from the inflation apparatus.

OBJECTS OF THE INVENTION

It is therefore an object of the invention to provide a new and improved apparatus for feeding plastic film from a source of supply to a plastic film processing machine such as a plastic bag making machine and the like, which overcomes the problems described above.

Another object of the invention is to automatically and conveniently accomplish the cutting, taking up and connecting of the plastic film fed from the source of supply when the plastic film processing machine is temporarily stopped and restarted.

SUMMARY OF THE INVENTION

According to the invention, an apparatus is provided for feeding a continuous plastic film from a source of supply to a plastic film processing machine such as a plastic bag making machine and the like, which includes first and second take up rolls for taking up and rewinding the plastic film. The first and second take up rolls are disposed on one side of a path along which the plastic film is fed from the source of supply to the processing machine. First guide means is disposed at a position in the path for directing the plastic film from the source of supply to the first take up roll via the first guide means. Second guide means is disposed downstream of the first guide means in the path for directing the plastic film from the second take up roll to the processing machine via the second guide means.

First heat cutting means and first receiving means extend widthwise of the plastic film. The first heat cutting means and the first receiving means are disposed on the one side of the path, and spaced from and opposed to each other in a direction substantially parallel to the path so that the plastic film between the first guide means and the first take up roll and the plastic film between the second take up roll and the second guide means are brought into opposite relation between the first heat cutting means and the first receiving means. First drive means is connected to at least one of the first heat cutting means and the first receiving means to move them relative to and toward each other so that the plastic films are sandwiched between and heat cut widthwise by the heat cutting means and the receiving means, whereby the plastic film from the source of supply is connected to the plastic film to the processing machine, while the plastic film to the first take up roll is connected to the plastic film from the second take up roll.

In addition, second heat cutting means and second receiving means extend widthwise of the plastic film. The second heat cutting means and the second receiving means are disposed in a plane between the first heat cutting means and the first receiving means, and spaced from and opposed to each other in a direction substantially crossing the path so that the plastic film between the source of supply and the processing machine and the plastic film between the first and second take up rolls are brought into opposite relation between the second heat cutting means and the second receiving means. Second drive means is connected to at least one of the second heat cutting means and the second receiving means to move them relative to and toward each other so that the plastic films are sandwiched between and heat cut widthwise by the second heat cutting means and the second receiving means, whereby the plastic film from the source of supply is connected to the plastic film to the first take up roll, while the plastic film from the second take up roll is connected to the plastic film to the processing machine.

In a preferred embodiment of the invention, the path comprises a horizontal path. The first and second take up rolls are disposed on the under side of the path. The first heat cutting means and the first receiving means are disposed on the under side of the path and above the level of the plastic film between the first and second take up rolls, and spaced from and opposed to each other in a horizontal direction substantially parallel to the path. The second heat cutting means and the second receiving means are spaced from and opposed to each other in a vertical direction substantially crossing the path.

The first heat cutting means comprises an impulse heater. The first receiving means comprises a rubber roller. The first drive means comprises an air or hydraulic cylinder connected to the first receiving means to move it toward the first heat cutting means.

The second heat cutting means also comprises an impulse heater, which is disposed above the level of the path. The second receiving means also comprises a rubber roller, which is disposed below the level of the plastic film between the first and second take up rolls. The second drive means also comprises an air or hydraulic cylinder, which is connected to the second receiving means to move it toward the second heat cutting means.

The source of supply comprises an inflation apparatus in which the molten plastic raw material is directed into a cylindrical die and blown up by air, whereby a tubular plastic film is continuously produced and fed, the plastic film being then heat cut widthwise in the processing machine comprising a bag making machine to make household garbage bags successively.

A pair of source of supply may be provided for feeding a pair of plastic films therefrom to a common single machine along a pair of paths. Each of the paths may be provided with the first and second take up rolls, the first and second guide means, the first and second heat cutting means, the first and second receiving means and the first and second drive means, respectively.

BRIEF DESCRIPTION OF THE DRAWINGS

The accompanying drawings illustrate principals and preferred embodiment of the invention, and together with the description serve to explain the principals of the invention, in which.

DETAILED DESCRIPTION OF THE PREFERRED EMBODIMENT

Figure 1:
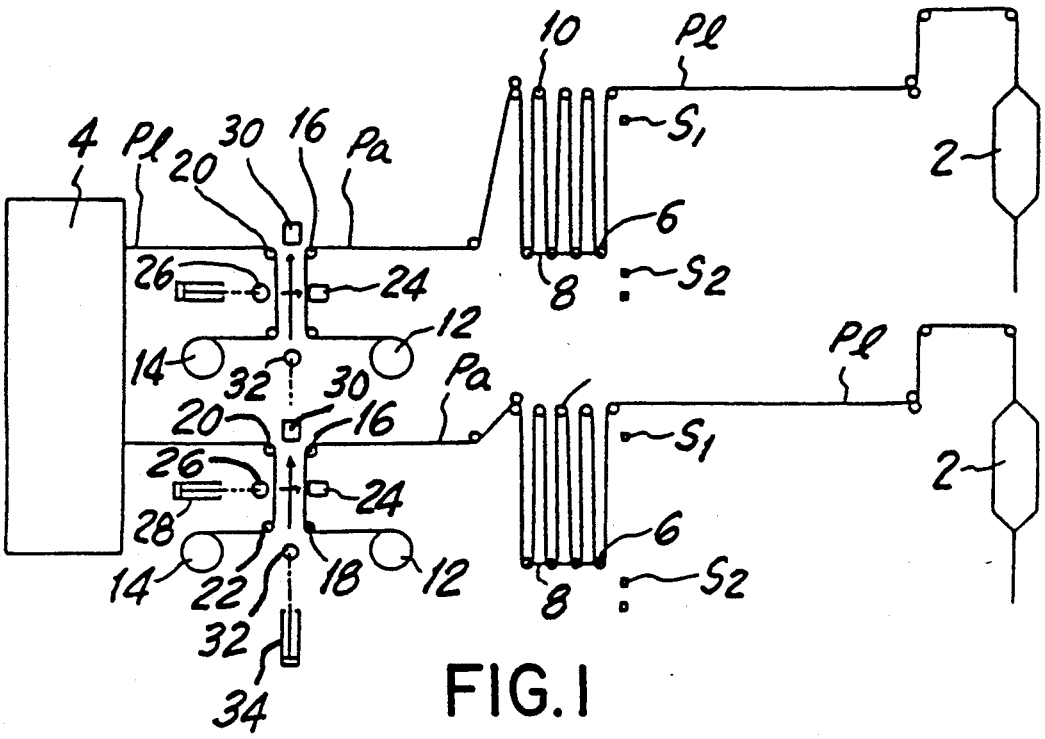
FIG. 1 is a schematic view of an apparatus for feeding a continuous plastic film according to the invention, showing the plastic films between the first guide means and the first take up rolls and the plastic films between the second take up rolls and the second guide means.

Referring to FIG. 1, there is illustrated an apparatus according to the invention in which a pair of plastic films Pl are fed from a pair of sources of supply 2 to a common single machine 4 which is a plastic film processing machine. The processing machine 4 comprises a plastic bag making machine. The sources of supply 2 comprise inflation apparatuses in each of which the molten plastic raw material is directed into a cylindrical die and blown up by air, whereby a tubular plastic film Pl is continuously produced and fed. The apparatus is constructed to connect the plastic films Pl from the sources of supply 2 to the plastic films Pl to the processing machine 4 described below. The tubular plastic films Pl are then fed to the processing machine 4 along a pair of paths Pa and heat cut widthwise in the processing machine 4 to make household garbage bags successively. Although reference will be made to only one of the plastic films Pl in the following for convenience, it should be noted that the elements mentioned below are provided for both of plastic films respectively. Each of the plastic films Pl is subjected to the function mentioned below.

The apparatus includes a plurality of dancer rollers 6 connected to each other by a bar 8. The plastic film Pl is directed to the dancer rollers 6 via guide rollers 10 between the source of supply 2 and the processing machine 4 to be engaged with the dancer rollers 6 and the guide rollers 10 and pooled therebetween. The processing machine 4 consumes the plastic film Pl to make household garbage bags at a speed higher than the feed speed of the plastic film Pl from the source of supply 2 so that the dancer rollers 6 are pulled up by the tension in the plastic film Fl when the processing machine 4 is driven. A sensor S1 is provided to detect that the dancer rollers 6 rise to an upper level in which the sensor S1 is positioned. The sensor S1 delivers a detection signal to a control apparatus not shown. The processing machine 4 is stopped by the control apparatus in response to the signal from the sensor S1. Accordingly, the dancer rollers 6 are then lowered by the gravity thereof in proportion to the amount of the plastic film Pl constantly fed from the source of supply 2 so that the plastic film Pl is pooled between the dancer rollers 6 and the guide rollers 10. A sensor S2 is provided to detect that the dancer rollers 6 are lowered to a lower level in which the sensor S2 is positioned. The sensor S2 delivers a detection signal to the control apparatus so that the processing machine 4 is restarted to consume the plastic film P1 and make household garbage bags. Accordingly, the dancer rollers 6 rise from the lower level toward the upper level.

First and second take up rolls 12 and 14 are provided for taking up and rewinding the plastic film Fl and disposed on one side of the path Pa between the dancer rollers 6 and the processing machine 4. The path Pa comprises a horizontal path. The first and second take up rolls 12 and 14 are disposed on the under side of the path Pa, and spaced from and opposed to each other in a horizontal direction substantially parallel to the path Pa. First guide means comprises a first guide roller 16 disposed at a position in the path Pa. An additional guide roller 18 is disposed under the first guide roller 16 for directing the plastic film Pl from the source of supply 2 to the first take up roll 12 via the first and additional guide rollers 16 and 18 as shown in FIG. 1. Second guide means comprises a second guide roller 20 disposed downstream of the first guide roller 16 in the path Pa. An additional guide roller 22 is disposed under the second guide roller 20 for directing the plastic film Pl from the second take up roll 14 to the processing machine 4 via the second and additional guide rollers 20 and 22 as shown in FIG. 1.

Figure 2:
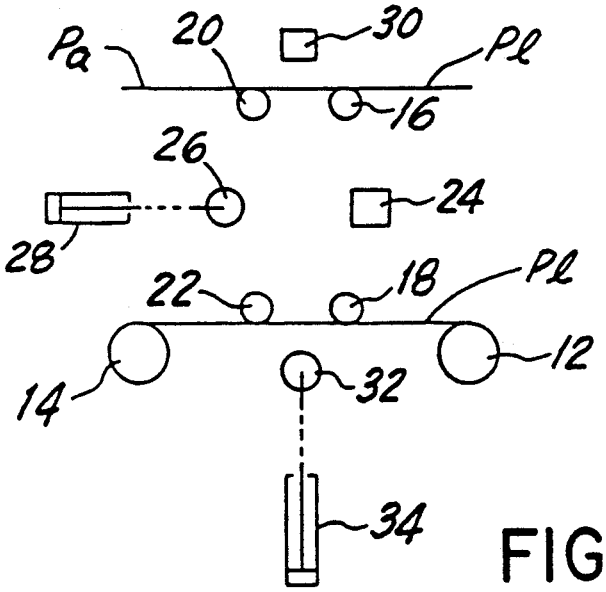
FIG. 2 is an enlarged schematic view of a portion of the apparatus of FIG. 1, showing the plastic film between the inflation apparatus and the bag making machine and the plastic film between the first and second take up rolls.

The apparatus includes first heat cutting means and first receiving means extending widthwise of the plastic film Pl, the first heat cutting means comprising a impulse heater 24, the first receiving means comprising a rubber roller 26. The impulse heater 24 and the rubber roller 26 are disposed on the under side of the path Pa and above the level of the plastic film Pl between the first and second take up rolls 12 and 14 as shown in FIG. 2. The impulse heater 24 and the rubber roller 26 are spaced from and opposed to each other in a horizontal direction substantially parallel to the path Pa so that the plastic film Pl between the first guide roller 16, the additional guide roller 18 and the first take up roller 12 and the plastic film Pl between the second take up roll 14, the additional guide roller 22 and the second guide roller 20 are brought into opposite relation between the impulse heater 24 and the rubber roller 26 as shown in FIG. 1.

First drive means comprises an air or hydraulic cylinder 28, which is connected to the rubber roller 26 to move it toward the impulse heater 24. The rubber roller 26 is adapted to be engaged with the plastic film Pl between the second and additional guide rollers 20 and 22 and the plastic film Pl between the first and additional guide rollers 16 and 18 so that the plastic films Pl are sandwiched between and heat cut widthwise by the impulse heater 24 and the rubber roller 26, whereby the plastic film Pl from the source of supply 2 is connected to the plastic film Pl to the processing machine 4, while the plastic film Pl to the first take up roll 12 is connected to the plastic film Pl from the second take up roll 14, as shown in FIG. 2.

The apparatus further includes second heat cutting means and second receiving means extending widthwise of the plastic film Pl, the second heat cutting means comprising an impulse heater 30, the second receiving means comprising a rubber roller 32. The impulse heater 30 and the rubber roller 32 are disposed in a plane between the impulse heater 24 and the rubber roller 26, and spaced from and opposed to each other in a vertical direction substantially crossing the path Pa so that the plastic film Pl between the source of supply 2 and the processing machine 4 and the plastic film Pl between the first and second take up rolls 12 and 14 are brought into opposite relation between the impulse heater 30 and rubber roller 32 as shown in FIG. 2. The impulse heater 30 is disposed above the level of the path Pa, the rubber roller 32 being disposed below the level of the plastic film Pl between the first and second take up rolls 12 and 14.

Second drive means comprises an air or hydraulic cylinder 34, which is connected to the rubber roller 32 to move it toward the impulse heater 30. The rubber roller 32 is adapted to be engaged with the plastic film Pl between the additional guide rollers 18 and 22 and the plastic film Pl between the first and second guide rollers 16 and 20 so that the plastic films Pl are sandwiched between and heat cut widthwise by the impulse heater 30 and the rubber roller 32, whereby the plastic film Pl from the source of supply 2 is connected to the plastic film Pl to the first take up roll 12, while the plastic film Pl from the second take up roll 14 is connected to the plastic film Pl to the processing machine 4 as shown in FIG. 1.

In this apparatus, when it is required to temporarily stop the processing machine 4 for adjustment, the processing machine 4 is stopped as the dancer rollers 6 rise to the upper level in which the senser S1 is positioned. Accordingly, the dancer rollers 6 can be then lowered under the gravity thereof to pool the plastic film Pl constantly fed from the source of supply 2 not stopped between the dancer rollers 6 and the guide rollers 10.

The cylinder 34 is then operated to heat cut the plastic films Pl by the second impulse heater 30 in a manner described above so that the plastic film Pl from the dancer rollers 6 and the source of supply 2 is separated from the plastic film Pl to the processing machine 4 and connected to the plastic film Pl to the first take up roll 12 as shown in FIG. 1. The take up roll 12 is then driven for rotation so that the plastic film Pl is directed from the dancer rollers 6 to the first take up roll 12 and taken up about the first take up roll 12 before the dancer rollers 6 reach the under level. The plastic film Pl can then be fed from the source of supply 2 not stopped to the dancer rolls 6 and the first take up roll 12 without relaxation of the plastic film Pl while the processing machine 4 is temporarily stopped. It is therefore not required to stop the source of supply 2 comprising a inflation apparatus. As the result of heat cutting the plastic films Pl, the plastic film Pl from the second take up roll 14 is connected to the plastic film Pl to the processing machine 4. Accordingly, the plastic film Pl can be rewound from the second take up roll 14 and fed to the processing machine 4 for adjustment if necessary.

When it is required to restart the processing machine 4 subsequently to the adjustment, the first and second take up rolls 12 and 14 and the processing machine 4 are stopped respectively as the dancer rollers 6 are pulled up to the upper level by the tension in the plastic film Pl taken up about the first take up roll 12. The dancer rollers 6 can be then lowered under the gravity to pool the plastic film Pl constantly fed from the source of supply 2 not stopped between the dancer rollers 6 and the guide rollers 10.

The cylinder 28 is then operated to heat cut the plastic films Pl by the first impulse heater 24 in a manner described above. Accordingly, the plastic film Pl from the dancer rollers 6 and the source of supply 2 is separated from the plastic film Pl to the first take up roll 12 and connected to the plastic film Pl to the processing machine 4 as shown in FIG. 2. The processing machine 4 is then restarted. The plastic film Pl is therefore fed from the source of supply 2 to the dancer rollers 6 and the source of supply 4 along the path Pa to make household garbage bags successively.

The plastic film Pl to the first take up roll 12 is connected to the plastic film Pl from the second take up roll 14. Accordingly, the plastic film Pl can be rewound from the first take up roll 12 to the second take up roll 14 for next adjustment of the processing machine 4.

The apparatus may be applied not only to the bag making machine but to a packaging machine for packaging articles in the plastic film. First and second heat cutting means other than impulse heaters 24 and 30 may be utilized. First and second drive means other than the cylinders 28 and 34 may be utilized.

What is claimed is:

1. An apparatus for feeding a continuous plastic film from a source of supply to a plastic film processing machine such as a plastic bag making machine and the like, comprising:

a first take up roll for taking up and rewinding the plastic film;

a second take up roll for taking up and rewinding the plastic film, said first and second take up rolls being disposed on one side of a path along which the plastic film is fed from said source of supply to said processing machine;

first guide means disposed at a position in said path for directing the plastic film from said source of supply to said first take up roll via said first guide means;

second guide means disposed downstream of said first guide means in said path for directing the plastic film from said second take up roll to said processing machine via said second guide means;

first heat cutting means extending widthwise of the plastic film;

first receiving means extending widthwise of the plastic film, said first heat cutting means and said first receiving means being disposed on said one side of the path, and spaced from and opposed to each other in a direction substantially parallel to said path so that the plastic film between said first guide means and said first take up roll and the plastic film between said second take up roll and said second guide means are brought into opposite relation between said first heat cutting means and said first receiving means;

first drive means connected to at least one of said first heat cutting means and said first receiving means to move them relative to and toward each other so that the plastic films are sandwiched between and heat cut widthwise by said first heat cutting means and said first receiving means, whereby the plastic film from said source of supply is connected to the plastic film to said processing machine, while the plastic film to said first take up roll is connected to the plastic film from said second take up roll;

second heat cutting means extending widthwise of the plastic film;

second receiving means extending widthwise of the plastic film, said second heat cutting means and said second receiving means being disposed in a plane between said first heat cutting means and said first receiving means, and spaced from and opposed to each other in a direction substantially crossing said path so that the plastic film between said source of supply and said processing machine and the plastic film between said first and second take up rolls are brought into opposite relation between said second heat cutting means and said second receiving means;

second drive means connected to at least one of said second heat cutting means and said second receiving means to move them relative to and toward each other so that the plastic films are sandwiched between and heat cut widthwise by said second heat cutting means and said second receiving means, whereby the plastic film from said source of supply is connected to the plastic film to said first take up roll, while the plastic film from said second take up roll is connected to the plastic film to said processing machine.

2. An apparatus as set forth in claim 1, wherein said path comprises a horizontal path, said first and second take up rolls being disposed on the under side of said path, said first heat cutting means and said first receiving means being disposed on the under side of said path and above the level of the plastic film between said first and second take up rolls, and spaced from and opposed to each other in a horizontal direction substantially parallel to said path, said second heat cutting means and said second receiving means being spaced from and opposed to each other in a vertical direction substantially crossing said path.

3. An apparatus as set forth in claim 1, wherein said first heat cutting means comprises an impulse heater, said first receiving means comprising a rubber roller, said first drive means comprising an air or hydraulic cylinder connected to said first receiving means to move it toward said first heat cutting means.

4. An apparatus as set forth in claim 1, wherein said second heat cutting means comprises an impulse heater disposed above the level of said path, said second receiving means comprising a rubber roller disposed below the level of the plastic film between said first and second take up rolls, said second drive means comprising an air or hydraulic cylinder connected to said second receiving means to move it toward said second heat cutting means.

5. An apparatus as set forth in claim 1, wherein said source of supply comprises an inflation apparatus in which the molten plastic raw material is directed into a cylindrical die and blown up by air, whereby a tubular plastic film is continuously produced and fed, the plastic film being then heat cut widthwise in said processing machine to make household garbage bags successively.

6. An apparatus as set forth in claim 1, wherein a pair of plastic films are fed from a pair of sources of supply to a common single machine along a pair of paths, each of the paths being provided with said first and second take up rolls, said first and second guide means, first and second heat cutting means, said first and second receiving means and said first and second drive means, respectively.

* * * * *